United States Patent [19]

Heinonen

[11] Patent Number: 4,907,650

[45] Date of Patent: Mar. 13, 1990

[54] WELLHEAD WITH SAFETY VALVE FOR PUMPING WELL

[75] Inventor: Robert L. Heinonen, Dallas, Tex.

[73] Assignee: Double E, Inc., Dallas, Tex.

[21] Appl. No.: 375,249

[22] Filed: Jul. 3, 1989

Related U.S. Application Data

[63] Continuation-in-part of Ser. No. 313,624, Feb. 21, 1989, abandoned, which is a continuation-in-part of Ser. No. 208,980, Jun. 23, 1988, abandoned, which is a continuation-in-part of Ser. No. 77,692, Jul. 24, 1987, abandoned.

[51] Int. Cl.[4] ..... E21B 33/03

[52] U.S. Cl. ..... 166/80; 166/84; 166/86; 166/97

[58] Field of Search ..... 166/80, 84, 86, 95, 166/97

[56] References Cited

U.S. PATENT DOCUMENTS

| | | | |
|---|---|---|---|
| 1,830,205 | 11/1931 | McLaine | 166/86 |
| 2,563,155 | 8/1951 | Cardwell | 166/84 |
| 3,078,921 | 2/1963 | Edwards | 166/86 |
| 3,424,247 | 1/1969 | Lee | 166/97 |
| 3,532,163 | 10/1970 | Ecuer | 166/84 |
| 3,821,984 | 7/1974 | Lee | 166/86 |
| 3,939,910 | 2/1976 | Bruce | 166/84 |
| 4,099,562 | 7/1978 | Mattoon | 166/80 |
| 4,109,713 | 8/1978 | Clow | 166/84 |
| 4,266,605 | 5/1981 | LaBorde | 166/97 |
| 4,415,026 | 11/1983 | Rezewski et al. | 166/84 |

*Primary Examiner*—Stephen J. Novosad
*Assistant Examiner*—Terry Lee Melius
*Attorney, Agent, or Firm*—Johnson & Gibbs

[57] ABSTRACT

A wellhead for a polished rod pumping unit to provide emergency closure of the bore through the wellhead in the event of breakage of the polished rod. The valve assembly includes a flapper valve mounted on a swivel pin for movement between a vertical open position and a horizontal closed position across the wellhead bore. The flapper valve is spring biased toward the open position. A well pressure responsive cylinder and piston assembly is mounted on the side of the wellhead with an operating rod into the wellhead against the flapper valve to move the valve from the open position to a horizontal closed position. The piston is exposed to well pressure on the one side urging the piston outwardly to the valve open position and a spring engages the piston on the opposite side biasing the piston inwardly toward the valve closed position when well pressure is not sufficient to keep the spring compressed. One form of the wellhead includes a packing assembly for sealing around the polished rod. A second embodiment includes only the valve assembly which is used with a standard packing assembly. A third embodiment of the wellhead includes a swivel mounted packing assembly to permit the polished rod to deviate from the vertical. The swivel mounted packing assembly may include a ball swivel member and ball swivel guide for holding said ball swivel against rotation while permitting the ball swivel to tilt.

22 Claims, 6 Drawing Sheets

WELLHEAD WITH SAFETY VALVE FOR PUMPING WELL

This application is a continuation-in-part of application Ser. No. 07/313,624, filed Feb. 21, 1989 by Robert H. Heinonen now abandoned, which is a continuation-in-part of application Ser. No. 07/208,980 filed June 23, 1988 now abandoned, which is a continuation-in-part of application Ser. No. 07/077,692 filed July 24, 1987, now abandoned.

FIELD OF THE INVENTION

This invention relates to wellheads for use with wells produced by reciprocating pumps operated by a polished rod connected with a pumping jack, and, more particularly relates to a wellhead having a safety valve for sealing around a polished rod through a wellhead.

HISTORY OF THE PRIOR ART

Wells, particularly petroleum oil wells, often must be produced by mechanical pumps when the natural earth formation pressure is depleted to the extent that such pressure will not displace the oil to the surface. One of the more common methods of producing such wells includes the use of a downhole reciprocating pump operated by a polished rod connected with a sucker rod string extending to the pump from a pumping jack at the surface above the wellhead. The oil in the well is lifted by the pump to the surface through well tubing or casing extending from the wellhead to the producing formation. Wellheads for pumping wells normally include a seal assembly for sealing around the reciprocating polished rod to prevent leakage of oil from the wellhead. In the event of breakage of the polished rod, malfunctioning of the seal assembly, and the need to replace the polished rod, it is desirable to provide a means of sealing in well pressure which may exist at the well head. In order to avoid well pressure loss and the consequent spillage of oil, and permit servicing of a polished rod wellhead, it has been known to provide such wellheads with safety valves which close when the polished rod breaks or is removed. Spring biased flapper valves are shown in the following U.S. Patents: U.S. Pat. No. 3,939,910, issued Feb. 24, 1976 to Albert I. Bruce; U.S. Pat. No. 4,099,562, issued July 11, 1978 to Ronald W. Mattoon; and U.S. Pat. No. 4,415,026 issued Nov. 15, 1983 to Joe Rezewski. A flapper type valve in a wireline device for closing a bore upon removal of the wireline is shown in U.S. Pat. No. 3,532,163 issued Oct. 6, 1970 to John H. Eouer. A similar type structure utilized with a drill pipe and having a flapper valve for closing the bore through the wellhead through which the drill pipe is operated is shown in U.S. Pat. No. 1,830,205, issued Nov. 3, 1931 to W. L. McLaine. In those patents showing a flapper valve for shutting off flow in the event of removal or breakage of a polished rod, the spring which biases the flapper valve closed is within the pressurized space of the wellhead around the polished rod. Also, in the structure shown in such patents, the flapper valve is held open by engagement with the side surface of the polished rod, and thus, the flapper valve tends to drag along the polished rod surface as the rod reciprocates resulting in wear along the valve surface. U.S. Pat. No. 2,563,155, issued Aug. 7, 1951 to G. L. Cardwell, shows a spring biased cylindrical plug which engages the side edge of the polished rod and moves into the bore of the wellhead closing off the bore if the polished rod breaks. U.S. Pat. No. 4,109,713, issued Aug. 29, 1978 to Joseph Kenton Clow, shows a polished rod wellhead including a loose or free ball valve member which is injected into the wellhead bore by a spring when the polished rod breaks. The ball drags along the side edge of the polished rod during reciprocation of the rod. U.S. Pat. No. 4,415,026 shows a device for a well pump rod which includes a spring biased safety valve arranged to drag against the pump rod and close in the event that the pump rod breaks. In all of these prior art devices the valve member is held open by and drags along the polished rod surface creating wear over a period of time. Additionally, in those instances where the spring is within the pressure chamber, there is the possibility of foreign solid matter interfering with spring operation and the possibility of well fluids accelerating spring deterioration. U.S. Pat. Nos. 3,424,247 and 4,266,605 each show wireline safety valves for closing the bore of a wellhead in the event that the wireline breaks. Each of these patents shows a device which uses a ball valve element essentially loose in the wellhead and moved to close the bore through which the wireline passes in response, at least in part, to pressure from below the ball raising the ball into a closed position. U.S. Pat. No. 3,424,247 shows a device which additionally includes a pressure drop responsive piston having an opening for the wireline and moving along an axis coincident with the wellhead axis responsive to a sudden drop in well pressure to urge the ball valve into a closed position. Further, in each of these prior art devices the well pressure within the wellhead performs no function in assisting to bias the valve member open.

SUMMARY OF THE INVENTION

It is a principal object of the invention to provide a new and improved safety valve in a wellhead for a polished rod pumping unit.

It is another object of the invention to provide a wellhead safety valve of the character described which closes when the polished rod breaks or is otherwise removed.

It is another object of the invention to provide a flapper type safety valve for a polished rod wellhead which does not drag along the side edge of the polished rod.

It is another object of the invention to provide a safety valve in a polished rod wellhead biased open by wellhead pressure.

It is another object of the invention to provide a wellhead for polished rod well pumping apparatus having a hinged flapper valve operated by a plunger mounted on a piston in a side mounted cylinder and exposed to well pressure on one side and engaged on the opposite side with a spring in the cylinder for biasing the piston and rod toward the flapper valve. The plunger extends into the wellhead housing though an opening large enough that solid matter such as trash will not block the cylinder and impair the movement of the piston toward the housing and flapper valve.

It is another object of the invention to provide well safety apparatus of the character described which includes a sensor for detecting the position of the flapper valve operator prong and piston.

It is another object of the invention to provide a wellhead safety valve which may be used with existing wellhead equipment such as a wellhead stuffing box.

It is another object of the invention to provide a wellhead safety valve in combination with a stuffing box for use with a polished rod pumping unit.

It is further object of the invention to provide a wellhead safety valve of the character described which includes a swivel or pivoted stuffing box to accommodate the wellhead to a deviation from the vertical of the polished rod where the well bore is not exactly straight.

It is a still further object of the invention to provide a wellhead safety valve of the character described having a swivel stuffing box including a swivel ball portion provided with fingers interlocking with guide slots in a ball swivel guide permitting swivel action of the stuffing box while holding the stuffing box against rotation relative to the longitudinal axis of the stuffing box.

In accordance with the invention, there is provided a polished rod wellhead including a wellhead housing adapted for mounting on a well tubing and having a bore for a pumping jack polished rod, a packing assembly in housing for sealing around the polished rod, a flapper valve pivotally mounted in the housing for movement between an open position and a closed position shutting off the bore through the housing, and a wellhead pressure responsive valve operator in a cylinder and coupled with the flapper valve for closing the valve when wellhead pressure drops. The cylinder has an opening into the housing large enough that well trash will not impair operation of the cylinder. One embodiment includes a stuffing box. Another embodiment of the device of the invention does not include a stuffing box so that the device may be used with existing wellhead equipment including the existing stuffing box. A still further embodiment of the invention includes a pivoted or swiveled stuffing box to accommodate the wellhead to a deviation of the polished rod from the vertical. One form of the swivel stuffing box has structure permitting the stuffing box to swivel while holding the stuffing box against rotation to facility making up the various parts of the stuffing box during assembly and servicing.

BRIEF DESCRIPTION OF THE DRAWINGS

The foregoing objects and advantages and a preferred embodiment of the polished rod wellhead of the invention will be better understood from the following detailed description taken in conjunction with the accompanying drawings wherein.

DETAILED DESCRIPTION OF THE PREFERRED EMBODIMENT

Figure 1:
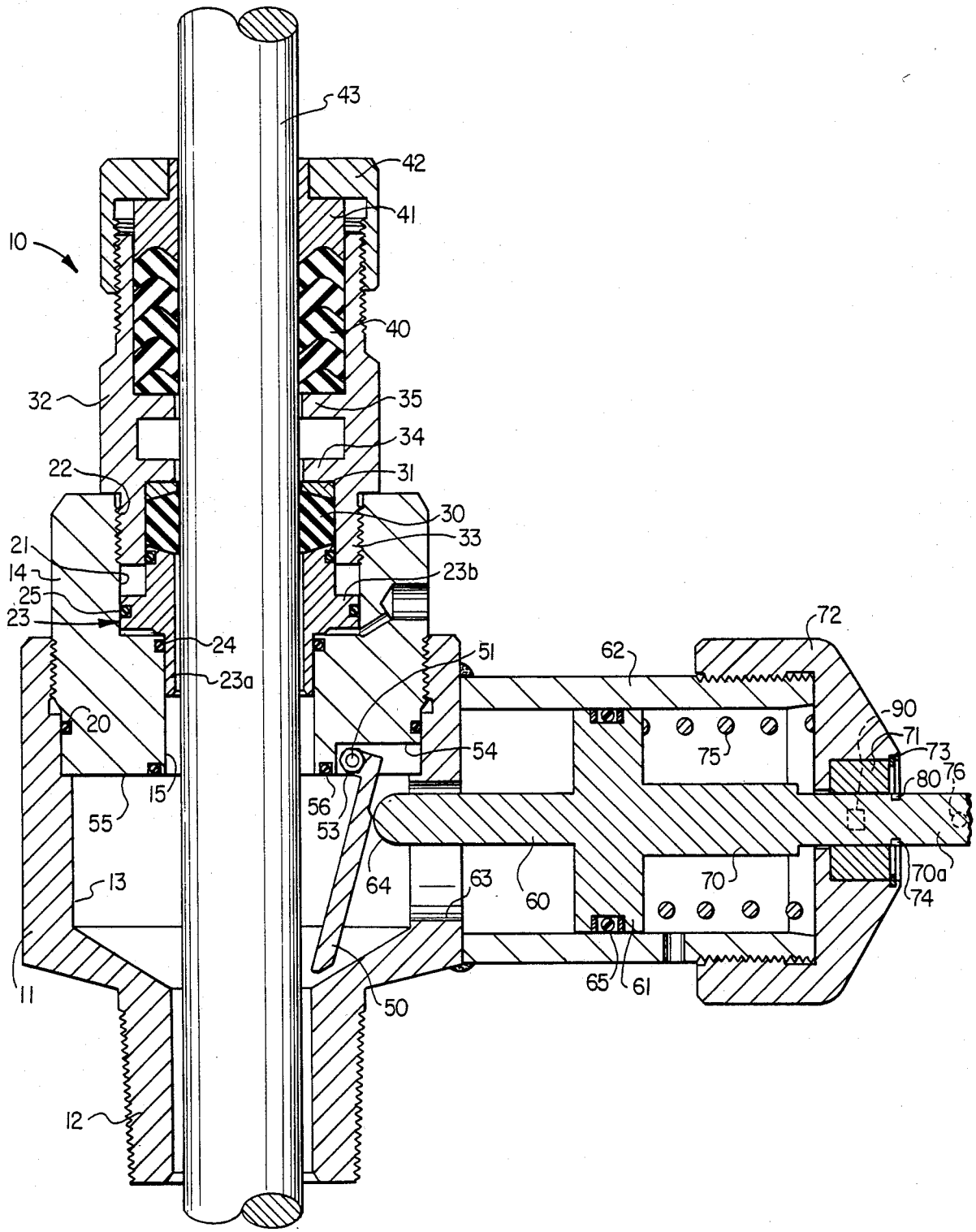
FIG. 1 is a side view in section and elevation of the wellhead of the invention showing the safety valve open and a polished rod extending through the wellhead.

Referring to the drawings, a polished rod wellhead 10 embodying the features of the invention is connected on a well tubing with a pumping jack unit, not shown, as illustrated in FIG. 1 of U.S. Pat. No. 4,415,026. The wellhead 10 has a lower body section 11 provided with a reduced, externally threaded, lower end portion 12 connectable to the upper end of a well tubing, not shown. The lower body section 11 has an internal, enlarged bore or valve chamber 13. An annular middle body section 14 is threaded into the upper end of the lower body section 11. The middle body section has a bore 15 opening into the lower body section bore 13. A ring seal 20 seals between the middle and lower body sections. The middle body section bore is graduated, having an enlarged upper bore portion 21 which is internally threaded at 22. A graduated bushing 23, preferably made of bronze, is positioned in the graduated bore of the middle housing section 14. The bushing has a lower skirt portion **23*a* which fits in the lower bore portion 15 and a central annular flange portion 23*b* which fits in the enlarged bore portion 21 of the housing section 14. A ring seal 24 seals between the skirt portion 23*a* and the surface defining the bore portion 15 of the housing section 14. A ring seal 25 seals between the flange 23*b* of the bushing and the surface defining the bore portion 21 of the housing section 14. A lower secondary packing ring 30 is mounted on the upper end of the bushing 23 held by a retainer ring 31. An upper body section 32 is threaded into the upper end of the middle body section 14. The upper body section has a reduced externally threaded end portion 33 which engages the internal threads 22 of the middle body section, telescoping over the bushing 23 and housing the lower packing 30 and the retainer ring 31. A lower internal annular flange 34 of the upper body section holds the retainer ring 31 in place. The upper body section 32 has an internal annular upper flange 35 which supports a set of upper primary packing rings 40 held in place by a bushing 41, preferably formed of bronze. An end retainer cap 42 is threaded on the upper end of the upper body section 32 holding the upper seal rings 40 and the bushing 41 in place. In FIG. 1 a polished rod 43 is illustrated in operating position through the wellhead 10. The polished rod extends from the pumping jack, not shown, above the wellhead 10 through the wellhead to the well pump, not shown, in the casing of the well. The polished rod reciprocates in sealed relationship through the upper seal rings 40 and the lower seal ring 30**. The upper and lower seal rings are formed of a suitable gasket-type material to resist deterioration by well fluids and to permit compression to the extent required to properly seal around the reciprocating polished rod at well pressure conditions.

Figure 2:
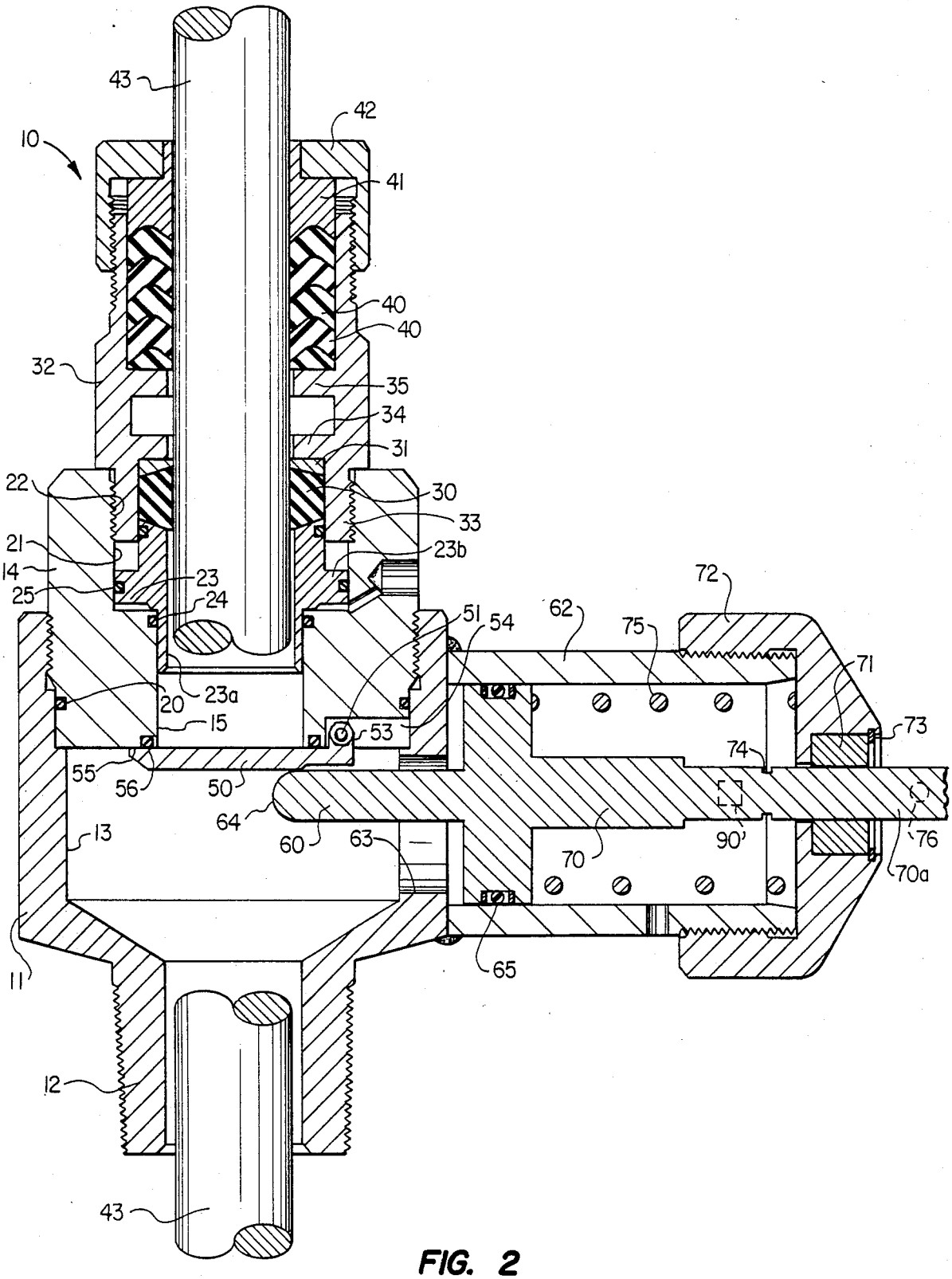
FIG. 2 is a side view similar to FIG. 1 showing the polished rod broken and the safety valve closed.

In accordance with the invention, a flapper valve 50 is mounted on a pivot pin 51 in the lower end of the middle body section 14 for movement between the open position illustrated in FIG. 1 and the closed position shown in FIG. 2. The flapper valve has a mounting arm 53 formed integral with the valve which is secured by the pin 51 in a downwardly opening slot 54 in the bottom face of the middle body section 14. The bottom face of the middle body section around the bore 15 defines a valve seat 55 for the flapper valve 50. A ring seal 56 in the seat 55 in the bottom face of the middle body section 14 seals between the upper face of the flapper valve and the valve seat shutting off the lower end of the bore portion 15 when the flapper valve is closed as in FIG. 2. The flapper valve is operated between the open position of FIG. 1 and the closed position of FIG. 2 by an operator prong 60 mounted on a piston 61 which slides within a cylinder 62 secured to the side face of the lower body section 11. The prong 60 extends through an opening 63 in the side of the body section 11. The opening 63 is as large as the design will permit to provide substantial space around the prong 60 between the chamber 13 and the bore of the cylinder 62. The opening 63 must be large enough that trash cannot collect in the cylinder around the prong to prevent the piston 61 moving to close the valve 50. The inward end 64 of the prong 60 is engageable with the bottom face of the flapper valve 50 to pivot the flapper valve from the open position to the closed position. A ring seal 65 around the piston 61 seals between the piston and the inner wall of the cylinder 62. A graduated guide rod 70 is secured with the piston 61 in axial alignment with the operator prong 60. A reduced outer end portion **70*a* of the rod 70 extends through a bushing 71 secured in an end cap 72 threaded over the outer end of the cylinder 62. The bushing 71 is held in place by a retainer snap ring 73. The portion 70*a* of the rod 70 has an external annular lookout recess 74 designed to receive a suitable locking clip, not shown, for holding the piston and operating rod at the outward valve open position shown in FIG. 1. The clip engages the outer end face of the bushing 71 holding the guide rod at the outer end position. A coil spring 75 is confined between the inner face of the end cap 72 and the outer face of the piston 61 biasing the piston inwardly toward the flapper valve 50. Operating recesses 76** in the outer end portion of the guide rod permit engagement by a suitable tool for pulling the guide rod, piston, and prong out to the valve-open position.

In operation, the wellhead 10 is installed on the upper end of well casing for operation of the polished rod 43 through the wellhead in the relationship illustrated in FIG. 1 of U.S. Pat. No. 4,415,026. For running the polished rod through the wellhead, it is necessary that the flapper valve 50 be locked open The piston 61 with the valve operating prong 60 is retracted by pulling the guide rod 70 outwardly using a suitable tool engaged with the tool sockets 76 in outer end portion of the guide rod. The guide rod is retracted to the valve open position shown in FIG. 1, at which the lookout recess 74 on the guide rod is at the outer face of the bushing 71. A lockout clip 80 is inserted in the recess 74 holding the guide rod with the piston and operating prong 60 at the outward valve-open position of FIG. 1. After the pump and polished rod are fully installed and connected with the pumping jack, the well is produced by operating the pumping jack to raise and lower the polished rod and sucker rod string. The pressure within the wellhead is communicated outwardly through the opening 63 around the valve operating prong 60 against the inner face of the piston 61 within the cylinder 62 holding the piston and the operator prong at the outward valve-open position, illustrated in FIG. 1, at which the spring 75 is compressed. The flapper valve 50 hangs downwardly pivoted to the open position, illustrated in FIG. 1, at which the polished rod 43 does not drag along the inside face of the flapper valve, and thus, wear the valve, as in the prior art. So long as the pumping system operates normally with the polished rod remaining intact the wellhead pressure holds the flapper valve at the open position illustrated.

In the event that the polished rod breaks with the lower portion of the rod dropping downwardly from the wellhead and that portion of the rod from the wellhead to the pumping jack being pulled upwardly from the wellhead as represented in FIG. 2, there is a sudden lose of pressure in the wellhead reducing the pressure within the cylinder 62 against the piston 61, permitting the spring 75 to expand. The expanding spring forces the piston 61 with the valve operating prong 60 inwardly through the opening 63 of the wellhead housing. The opening 63 is large enough that trash which might collect in the cylinder in front of the piston 61 will be pushed back into the chamber i3 without blocking the piston movement. The inward end 64 of the prong 60 pivots the flapper valve 50 clockwise upwardly to the closed position against the seat 55 and ring seal 56 illustrated in FIG. 2. Closure of the flapper valve prevents any further loss of well fluids through the wellhead. It will be apparent that if the polished rod breaks at a location either above or below the wellhead which permits a section of the polished rod to remain through the wellhead seals 30 and 40 the pressure tight integrity of the wellhead will remain, even though the polished rod has broken. In such event, it is likely that the polished rod may extend through the wellhead at the flapper valve, so that the flapper valve cannot close, which, of course, presents no problem since the wellhead remains sealed, even though the polished rod has broken at a location other than at the wellhead. The primary function of the flapper value is to prevent loss of fluids through the wellhead where the polished rod breaks and drops or is pulled from the two seals 30 and 40.

If desired, the bushing 71 may be made of magnetic material and a suitable detector 90 may be installed in the guide rod end portion to indicate when the guide rod is outward at a valve-open position for remote monitoring of the valve operation.

Figure 3:
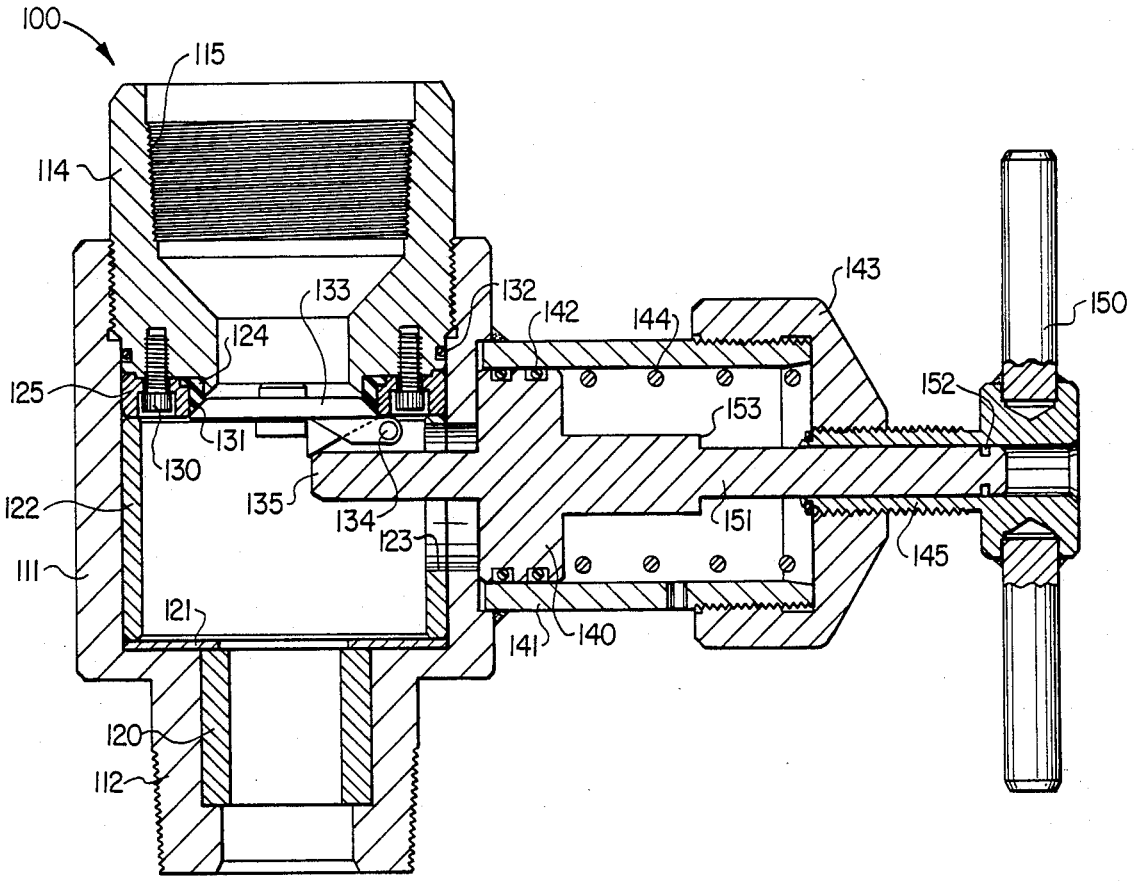
FIG. 3 is a side view similar to FIGS. 1 and 2 showing the valve system of the invention designed for use with an existing stuffing box for sealing around the polished rod.

A second embodiment 100 of the wellhead of the invention is illustrated in FIG. 3. The wellhead 100 has essentially the same features as the wellhead 10 with the exception of the polished rod seal assembly. The wellhead 100 is designed for installation with existing wellhead equipment and thus will accept a standard seal assembly for sealing around the polished rod.

Referring to FIG. 3, the wellhead 100 includes a housing or base 111 having a threaded lower end portion 112 for a connection with the upper end of well tubing. A retainer sub 114 is threaded into the upper end of the housing 111. The sub 114 is internally threaded at 115 for connection of a suitable available seal assembly, such as illustrated in FIG. 1, for sealing around the sucker rod 43 shown in FIG. 1. A bushing 120 is positioned in the bore of the reduced lower end portion 112 of the housing. A bushing retainer 121 is positioned in the bore of the housing engaged with the upper end of the bushing 120. A tubular flapper cage 122 is positioned in the bore of the housing on the bushing 121.

The flapper cage has a side opening 123 for a valve operator rod. The opening 123 is substantially larger than the prong 135 to keep trash from collecting in the cylinder 141 which might block operation of the piston 140 to close the flapper valve 133. A flapper seal 124 is secured to the lower face of the retainer sub by a seal retainer 125 held on the retainer sub by spaced screws 130. The flapper seal has a tapered lower end face 131 defining a flapper valve seat. A ring seal 132 seals around the lower end portion of the retainer sub with the bore of the housing 111. A flapper valve 133 is pivoted on a pin 134 connected to the cage 122 for movement between an open position shown in FIG. 1 and a closed position as illustrated in FIG. 3. The flapper valve has an upwardly and inwardly tapered edge for seating with the valve seat 131 to shut off flow from the bore of the housing upwardly into the bore of the retainer sub. A valve operator rod 135 is mounted on a closure piston 140 for moving the flapper valve from the open position of FIG. 1 to the closed position shown in FIG. 3. The piston 140 operates in a cylinder 141 secured, as by welding, to the side of the housing 111. Ring seals 142 in external annular recesses around the piston seal between the piston and the internal wall of the cylinder. An end cap 143 is threaded on the outer end of the cylinder. A spring 144 is compressed in the cylinder between the end cap 143 and the outer surface of the piston 140 to bias the piston and operator rod 135 inwardly to the valve closed position shown in FIG. 3. An externally threaded tubular closure screw 145 is threaded through the end cap. A handle 150 is mounted on the closure screw for rotating the screw. A piston rod 151 on the piston 140 extends in sliding relation into the bore of the closure screw. An externally annular stop shoulder 153 is formed on the piston rod 151 located within the cylinder. The length of the piston rod 151 outwardly from the stop shoulder 153 is sufficiently longer than the closure screw 145 and the screw handle that when the closure screw is screwed fully inwardly engaging the shoulder 153, the locking recess 152 is outward of the handle end face of the handle substantially aligned with the end face for use when opening and looking the valve open using the closure screw.

In operation, the wellhead 100 is connected with surface pipe, not shown, of a well to be pumped and an available seal assembly such as illustrated in FIG. 1 is connected with the wellhead 100 at the threads 115 and the retainer sub 114. During the installation of the wellhead and at any time thereafter when it is necessary to lock the flapper valve 133 open, the closure screw 145 is rotated by the handle 150 inwardly until the inward end of the closure screw engages the stop shoulder 153 on the piston rod 151. At this position of the closure screw on the piston rod, the looking recess 152 is aligned with the outer face of the handle and a C-ring, not shown, sufficiently large to engage the outer face of the handle is installed in the recess 152 coupling the handle closure screw with the piston rod. The handle is then rotated to back the closure screw outwardly against the compression of the spring 144 retracting the piston rod 151 with the piston 140 and the valve operator rod 135 outwardly to the position illustrated in FIG. 1. The spring on the flapper valve 133 rotates the flapper valve to the open position of FIG. 1. When the well is then in operation with pressure in the housing 111, the C-ring is removed from the locking recess of the piston rod so that the piston and valve operator rod will be free to move inwardly responsive to the pressure of the spring 144. The well pressure during well operation is sufficient as applied to the piston 140 from within the housing 111 to hold the piston outwardly at the position of FIG. 1 at which the flapper valve 133 remains open and does not contact the polished rod. In the event of a loss of well pressure, and in particular breaking of the polished rod, the spring 144 urges the piston 140 inwardly with the operator rod 135 acting against the flapper valve 133 pivoting the flapper valve to the closed position illustrated in FIG. 3 at which the flapper valve engages the seat surface 131. The opening 123 is large enough that trash in the cylinder 141 in front of the piston 140 will be pushed back into the valve housing and not block or jam the piston from closing the flapper valve. During the operation of the well with pressure within the housing it will be evident that the polished rod does not drag along the flapper valve as it reciprocates Thus, the wellhead 100 has essentially the same parts and functions similarly to the wellhead 10 except that the wellhead 100 is usable with polished rod packing assemblies of standard design which will fit the threads 115 in the retainer sub 114 of the wellhead.

Figure 4:
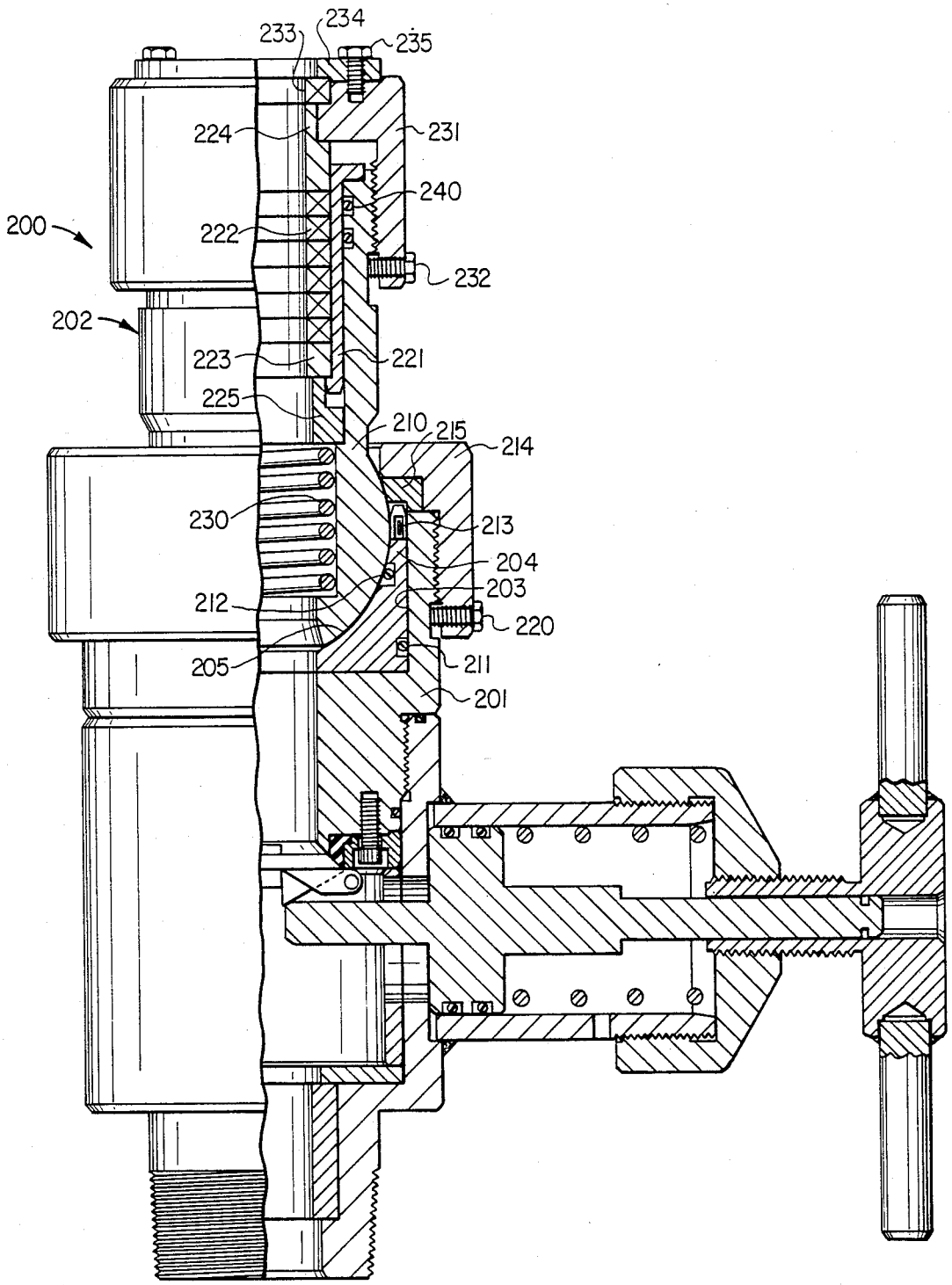
FIG. 4 is a side view in elevation and section similar to Figs. 1—3 showing another embodiment of the stuffing box for use with polished rods which reciprocate along an axis deviating from the vertical.
Figure 5:
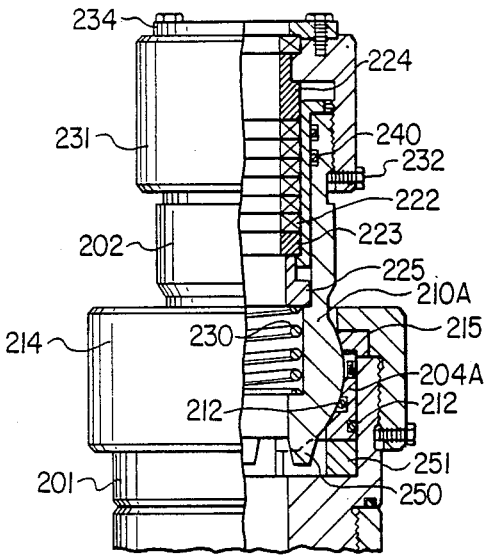
FIG. 5 is a fragmentary view in section and elevation of a swivel stuffing box section of another embodiment of the wellhead stuffing box of FIG. 4.
Figure 6:
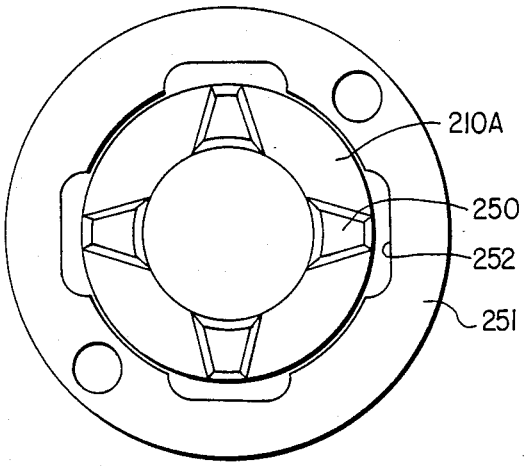
FIG. 6 is a bottom view of only the ball swivel and the ball swivel bushing of the device of FIG. 5.

Referring to FIG. 4, the valve within the wellhead 200 is identical to the wellhead 100 and all of the parts are identified by the same reference numerals as applied to the wellhead 100 of FIG. 3. The retainer sub 201 is threaded into the base 111 for supporting a swivel seal assembly or stuffing box 202 connected with the valve assembly. The sub 201 has an enlarged upper bore portion 203 for a ball swivel bushing 204 preferably made of a material such as bronze. The swivel bushing has an internal surface 205 formed in the shape of a section of a sphere to provide a bearing surface for the lower ball-shaped end of a ball swivel member 210. A ring seal 211 seals between the ball swivel bushing and the bore of the retainer sub, and a ring seal 212 seals between the ball swivel bushing and the ball-shaped lower end portion of the swivel member 210. Another seal 213 seals between the ball swivel member and the bore of the retainer sub 201 above the bushing 204. A ball swivel cap 214 and a ball swivel cap bushing 215 are secured on the upper end of the retainer sub 201 to hold the ball portion of the member 210 in position in the bushing 205. Bolts 220 secure the cap 214 on the retainer sub 201. A packing sleeve 221 is mounted in the bore of the upper cylindrical portion of the ball swivel member 210. A packing assembly 222 comprising a plurality of annular packing members, is supported in the packing sleeve between a packing bushing 223 and a cap bushing 224. The bushing 223 rests on a packing piston 225 which is biased upwardly by a spring 230, compressed within the ball portion of the swivel member 210 for keeping the packing assembly in a compressed stressed state. A cap 231 is threaded on the upper end of the ball member 210 secured by circumferentially spaced bolts 232. The cap 231 engages the cap bushing 224 holding the bushing downwardly to compress the steel assembly 222 against the packing bushing 223. A wiper ring 233 is held in the cap 231 by a wiper ring retainer 234 as secured to the cap 231 by bolts 235. Ring seals 240 within the member 210 seal between the bore of the member 210 and the packing sleeve 221. The member 213 is a graphite fabric reinforced teflon seal having a spring encased inside. The spring 230 below the packing piston 225 loads the packing assembly from the lower end, while the shoulder on which the packing piston rests permits a heavy load to be applied from the upper end of the packing assembly. The packing sleeve 221 permits the entire packing assembly, including the packing bushing 223, to be pulled from the member 210. The ball swivel bushing 204 and the ball swivel cap bushing 215 are both softer than the ball portion of the swivel member 210 to prevent galling of the ball portion surface. The coupling of the ball portion of the member number 210 into the valve assembly at the ball swivel bushing and the bushing cap permits the ball swivel assembly to move relative to the valve assembly to compensate for deviations from the vertical of a polished rod passing down into a well bore through the valve assembly. It has been found that a deviation of as much as seven degrees from the vertical in the polished rod can be tolerated through the wellhead 200 because of the swivel joint connection provided. It will be apparent that the valve assembly itself works in exactly the same manner as the valve 100 and the valve 10 previously described. The lower bushing 120 acts as an additional centralizer for the polished rod and a wiper to keep paraffin away from the flapper valve and the flapper valve C.

In the event well conditions develop which prevent normal valve closure by the spring 144, the valve may be manually closed. The handle 150 is rotated turning the closure screw 145 to engage the inward end of the screw with the piston rod shoulder 153. Continued rotation of the closure screw then forces the piston and operator rod 135 against the valve 133 closing the valve.

Figure 7:
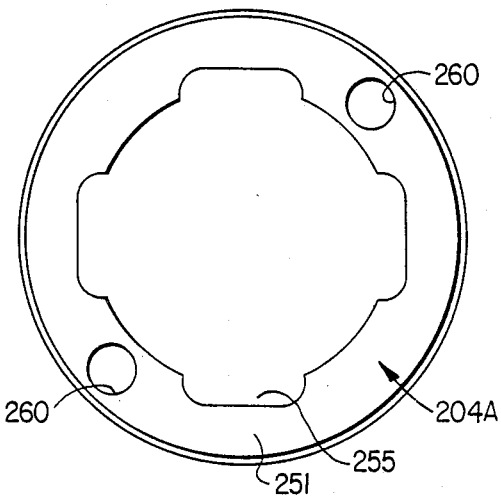
FIG. 7 is a bottom view of the ball swivel bushing of the stuffing box of FIG. 5.
Figure 8:
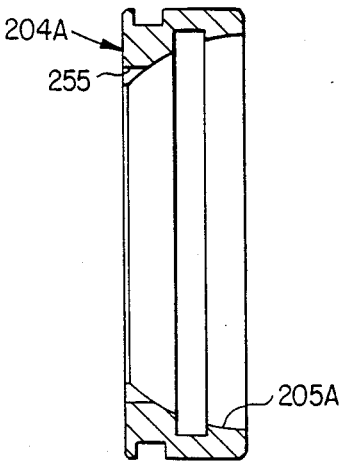
FIG. 8 is a vertical section through the bushing of FIG. 7.
Figure 9:
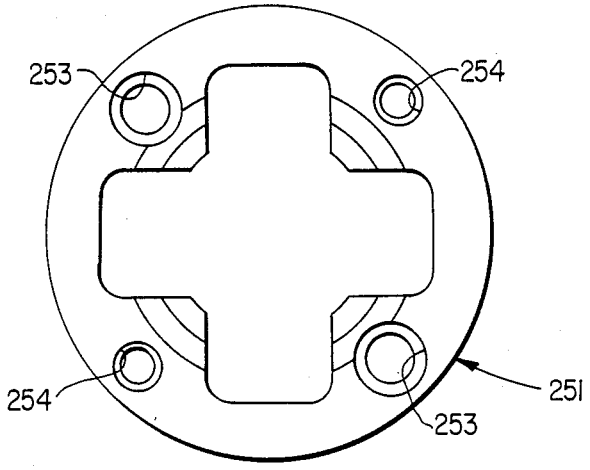
FIG. 9 is a top view of the ball swivel guide of the device of FIG. 5.
Figure 11:
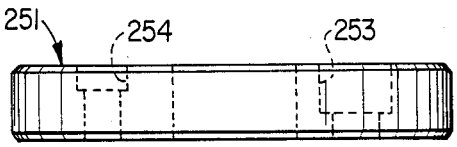
FIG.11 is a side view in elevation of the ball swivel guide of FIGS. 9 and 10 showing securing and alignment holes in phantom lines.
Figure 10:
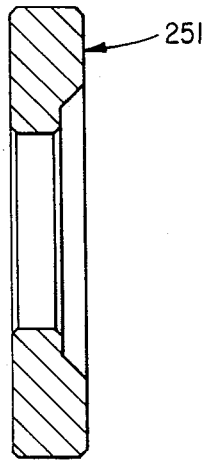
FIG. 10 is a view in section of a circular blank used to form the ball swivel guide of FIG. 9 prior to drilling the holes and machining the slots shown in FIG. 9.

A still further form of wellhead 200A is illustrated in FIGS. 5–11. The wellhead 200A is identical in all respects to the wellhead 200 with the exception of features which limit or prevent rotation of the ball swivel to permit assembly and adjustment of the various parts connected to the ball swivel without the need to place a pipe wrench around the body of the ball swivel. All identical parts of the wellhead 200A are identified by the same numbers as applied to the wellhead 200 in FIG. 4. Those modified parts of the wellhead 200A equivalent to corresponding parts of the wellhead 200 are identified by the same reference numerals as used in FIG. 4 with "A" added as a suffix. The ball swivel 210A has circumferentially spaced integral dependant or downwardly extending tapered guide fingers 250 disposed around the bore through the ball swivel radially inwardly from the maximum diameter of the ball swivel. A ring shaped ball swivel guide 251 is mounted in the retainer sub 201 below the ball swivel bushing 204A. As seen in FIGS. 6 and 9–11 the ball swivel guide has internal circumferentially spaced slots 251 positioned and shaped to receive the guide fingers 250 allowing radial movement of the guide fingers as the ball swivel tilts to various angles while restricting the rotation of the ball swivel. The coaction between the ball swivel fingers 250 and slots 252 prevent rotation of the ball swivel about the axis of the swivel so that the various parts attached to the ball swivel including the cap 231 may be tightened during assembly and thereafter adjusted without putting a pipe wrench on the ball swivel to hold the ball swivel against rotation. As evident in FIGS. 9 and 10 the top face of the ball swivel guide is graduated downwardly and inwardly to accommodate the spherical lower end portions of the ball swivel. The ball swivel guide has two graduated holes 253 drilled from the top face of the guide downwardly through the guide to receive set screws for securing the guide to the retainer sub 201 so that the guide cannot turn relative to the retainer sub permitting the guide to restrain the ball swivel against rotation because the ball swivel fingers 250 are engaged in the ball swivel guide slots 252. The ball swivel guide also has graduated holes 254 for screws, not shown, which align the ball swivel bushing with the ball swivel guide. As seen in FIGS. 7 and 8, the ball swivel bushing has a spherical bore to conform with the spherical surface of the ball swivel and circumferentially spaced slots 255 aligned with the slots 252 in the ball swivel guide for the guide fingers 250. The bottom face of the ball swivel bushing has blind holes 260 sized and shaped to align with the upper ends of the holes 254 in the ball swivel guide. The holes 260 receive the heads of the alignment pins in the holes 254 of the ball swivel guide to properly align and maintain the alignment between the ball swivel guide and the ball swivel bushing.

It will be evident from the foregoing description and the drawings that new and improved polished rod wellheads for a pumping unit have been described and illustrated. The flapper valve used to close off the wellhead in the event of polished rod breakage is held open by wellhead pressure at a position at which the polished rod does not drag along the face of the flapper valve causing damage to the valve. The flapper valve is spring biased toward a closed position so that when the wellhead pressure suddenly decreases due to the polished rod breaking and being pulled from the wellhead, the flapper valve is closed immediately. One form of the wellhead is used with an existing stuffing box. Another form of the wellhead includes a fixed stuffing box. A further form includes a swivelled packing for non-vertical polished rods. An alternate form of the stuffing box wellhead having the swiveled packing includes a ball joint having fingers meshing with slots in a ball swivel guide to permit the ball joint to pivot while holding the ball joint against rotation to facilitate assembly and adjustment of the wellhead stuffing box.

What is claimed is:

1. A wellhead for a polished rod pumping unit comprising:

a wellhead housing having a bore for a polished rod and adapted for mounting on a well tubing;

a flapper type valve mounted in said housing for closing said bore upon removal of a polished rod from said bore; and wellhead fluid pressure responsive valve operator means coupled with said valve permitting said valve means to remain open when said wellhead is under fluid pressure, and for closing said valve means in the absence of said polished rod from said bore and the reduction of fluid pressure in said housing below a predetermined level, said valve operator means including a prong engageable with said valve means for moving said valve means from an open to a closed position and a piston connected with said prong, one side of said piston communicating with fluid pressure in said housing for holding said piston and prong at a valve open position, and a spring engaged with said piston for biasing said piston and said prong toward a valve-closed position, said piston and said prong being mounted in a cylinder secured on a side of said housing and said prong extending through an opening in said housing from said cylinder.

2. A wellhead in accordance with claim 1 wherein said housing is provided with a valve seat around said bore in a plane perpendicular to the longitudinal axis of said bore, a ring seal mounted in said seat for engagement by a face of said valve, and said valve is pivotally secured on an axis parallel with said plane of said valve seat whereby said valve pivots from a first open position to a second closed position engaging said ring seal in said valve seat.

3. A wellhead in accordance with claim 2 including a guide rod secured with said piston extending from said piston along an axis in a direction opposite to the direction of said valve operating prong, said guide rod having means for retracting said rod to pull said piston and prong outwardly to a valve-open position and means for releasably looking said guide rod at said outward valve-open position.

4. A wellhead in accordance with claim 3 including a magnetic bushing around said guide rod at an outward end of said cylinder and a magnetic responsive sensor in said guide rod for detecting and indicating when said guide rod is at an outward valve-open position of said valve operator prong.

5. A wellhead for operating a pumping unit polished rod in a pumping well comprising:

a lower housing section having means along a lower end thereof for connection with a tubing of a well, said lower housing section having a chamber therein;

an upper housing section connected into said lower housing section;

said lower, and upper housing sections having longitudinal bores defining a bore through said wellhead housing along a longitudinal axis of said housing for receiving a polished rod from a pumping unit through said housing to a sucker rod string to a pump in said well;

means defining a valve seat in a lower face of said upper housing section around said bore;

a ring seal in said valve seat around said bore;

a flapper valve mounted on a pivotal axis in the bottom of said upper housing section for movement between a first open position and a second closed position engaging said valve seat and said ring seal in said valve seat over said bore from said middle housing section into said lower housing section;

a cylinder secured to a side of said lower housing section, said cylinder having a longitudinal axis extending perpendicular to the pivotal axis of said flapper valve spaced from said pivotal axis;

said lower housing section having a side opening having an axis coincident with the axis of said cylinder and sufficiently large to prevent trash collecting in said cylinder;

a piston provided with an external annular seal ring slidably disposed in said cylinder for movement along the axis of said cylinder;

a valve operating prong secured with said cylinder extending through said side opening of said lower housing section, said operating prong having an axis coincident with the axis of said piston and having an inward end engageable with an outer face of said flapper value for moving said flapper valve from a downward open position to a horizontal closed position responsive to inward longitudinal movement of said piston and operator prong;

a graduated guide rod secured with the outer face of said piston along an axis coincident with the axes of said operator prong and said piston;

a closure cap over the outward end of said cylinder, said closure cap having a central opening therein for said guide rod extending from said piston;

a spring in said cylinder compressed between the outer face of said piston and the inner face of said cylinder cap for biasing said piston and operator prong inwardly toward said flapper valve;

means along an outward end portion of said guide rod for retracting said guide rod, said piston, and said operator prong outwardly to a valve open position; and locking recess means on said guide rod for engagement of a locking clip to hold said guide rod outwardly at said valve-open position.

6. A wellhead in accordance with claim 5 including a magnetic bushing in said cylinder closure cap around said guide rod; and a sensor in said guide rod responsive to said magnetic bushing for detecting longitudinal position of said guide rod to determined when said guide rod, piston, and operator prong are at an outward valve-open position.

7. A wellhead in accordance with claim 6 wherein said means for retracting said guide rod, said piston, and said operator prong comprise a closure screw threaded through closure cap of said cylinder and adapted to be threaded inwardly until said locking recess on said guide rod is engagable by said locking clip for mechanically pulling said guide rod back outwardly to open said flapper valve and for threading inwardly to mechanically close said flapper valve.

8. A wellhead in accordance with claim 1 including a ball type swivel member connected with said housing having a bore communicating with the bore of said housing and adapted to swivel from a first position at which the longitudinal axis of said ball swivel member is coincident with the longitudinal axis through said housing to positions at which said axis of said ball swivel member is aligned at an angle with said axis of said housing for accommodating a polished rod moving along an axis deviated from the vertical, and a seal assembly in said ball swivel member for providing a seal around said polished rod.

9. A wellhead in accordance with the claim 8 including spring means in said ball swivel member engaged with a lower end of said seal assembly to provide a compressive load on the lower end of said seal assembly.

10. A wellhead in accordance with claim 9 wherein said seal assembly is mounted in a packing sleeve in said ball swivel member to facilitate removal of said seal assembly for servicing said wellhead.

11. A wellhead in accordance with claim 8 wherein said ball swivel member has rotation limiting guide fingers formed integral with the lower end of said member and including a ball swivel guide mounted in said housing having guide slots receiving said guide fingers on said ball swivel member permitting said ball swivel member to tilt while holding said member against rotation.

12. A wellhead in accordance with claim 1 wherein said opening from said cylinder into said housing is substantially larger than said prong to allow trash from said cylinder to be pushed by said piston into said housing without blocking movement of said piston to close said flapper valve.

13. A wellhead in accordance with claim 10 wherein said opening from said cylinder into said housing is substantially larger than said prong to allow trash from said cylinder to be pushed by said piston into said housing without blocking movement of said piston to close said flapper valve.

14. A wellhead in accordance with claim 11 wherein said opening from said cylinder into said housing is substantially larger than said prong to allow trash from said cylinder to be pushed by said piston into said housing without blocking movement of said piston to close said flapper valve.

15. A wellhead for operating a pumping unit polished rod in a pumping well comprising:

a wellhead housing having a bore for a polished rod and adapted for mounting on a well tubing;

seal means in said housing for sealing around a polished rod moving through said bore of said housing;

a flapper type valve mounted in said housing for closing said bore upon removal of a polished rod from said bore; and wellhead fluid pressure responsive valve operator means coupled with said valve permitting said valve means to remain open when said wellhead is under fluid pressure, and for closing said valve means in the absence of said polished rod from said bore and the reduction of fluid pressure in said housing below a predetermined level, said valve operator means including a prong engageable with said valve means for moving said valve means from an open to a closed position and a piston connected with said prong, one side of said piston communicating with fluid pressure in said housing for holding said piston and prong at a valve-open position, and a spring engaged with said piston for biasing said piston and said prong toward a valve-closed position, said piston and said prong being mounted in a cylinder secured on a side of said housing and said prong extending through an opening in said housing from said cylinder.

16. A wellhead in accordance with claim 15 wherein said housing is provided with a valve seat around said bore in a plane perpendicular to the longitudinal axis of said bore, a ring seal mounted in said seat for engagement by a face of said valve, and said valve is pivotally secured on an axis parallel with said plane of said valve seat whereby said valve pivots from a first open position to a second closed position engaging said ring seal in said valve seat.

17. A wellhead in accordance with claim 16 including a guide rod secured with said piston extending from said piston along an axis in a direction opposite to the direction of said valve operating prong, said guide rod having means for retracting said rod to pull said piston and prong outwardly to a valve-open position and means for releasably looking said guide rod at said outward valve-open position.

18. A wellhead in accordance with claim 17 wherein said seal means in said housing comprises a first primary seal assembly within an upper end portion of said housing and a second secondary seal assembly within said housing between said primary seal assembly and said valve.

19. A wellhead in accordance with claim 18 including a magnetic bushing around said guide rod at an outward end of said cylinder and a magnetic responsive sensor in said guide rod for detecting and indicating when said guide rod is at an outward valve-open position of said valve operator prong.

20. A wellhead for operating a pumping unit polished rod in a pumping well comprising:

a lower housing section having means along a lower end thereof for connection with a tubing of a well, said lower housing section having a chamber therein;

a middle housing section connected into said lower housing section;

an upper housing section connected into said middle housing section;

said lower, middle, and upper housing sections having longitudinal bores defining a bore through said wellhead housing along a longitudinal axis of said housing for receiving a polished rod from a pumping unit through said housing to a sucker rod string to a pump in said well;

a first primary seal in said upper housing section for sealing with a polished rod through said housing;

a second secondary seal in a lower portion of said upper housing section and said middle housing section for sealing with said polished rod;

means defining a valve seat in a lower face of said middle housing section around said bore;

a ring seal in said valve seat around said bore;

a flapper valve mounted on a pivotal axis in the bottom of said middle housing section for movement between a first open position and a second closed position engaging said valve seat and said ring seal in said valve seat over said bore from said middle housing section into said lower housing section;

a cylinder secured to a side of said lower housing section, said cylinder having a longitudinal axis extending perpendicular to the pivotal axis of said flapper valve spaced from said pivotal axis;

said lower housing section having a side opening having an axis coincident with the axis of said cylinder and being sufficiently large to prevent trash collection in said cylinder from said well;

a piston provided with an external annular seal ring slidably disposed in said cylinder for movement along the axis of said cylinder;

a valve operating prong secured with said cylinder extending through said side opening of said housing, said operating prong having an axis coincident with the axis of said piston and having an inward end engageable with an outer face of said flapper value for moving said flapper valve from a downward open position to a horizontal closed position responsive to inward longitudinal movement of said piston and operator prong;

a graduated guide rod secured with the outer face of said piston along an axis coincident with the axes of said operator prong and said piston;

a closure cap over the outward end of said cylinder, said closure cap having a central opening therein for said guide rod extending from said piston;

a spring in said cylinder compressed between the outer face of said piston and the inner face of said cylinder cap for biasing said piston and operator prong inwardly toward said flapper valve;

means along an outward end portion of said guide rod for retracting said guide rod, said piston, and said operator prong outwardly to a valve open position; and looking recess means on said guide rod for engagement of a looking clip to hold said guide rod outwardly at said valve-open position.

21. A wellhead in accordance with claim 20 including a magnetic bushing in said cylinder closure cap around said guide rod; and a sensor in said guide rod responsive to said magnetic bushing for detecting longitudinal position of said guide rod to determined when said guide rod, piston, and operator prong are at an outward valve-open position.

22. A wellhead in accordance with claim 21 wherein said means for retracting said guide rod, said piston, and said operator prong comprise a closure screw threaded through closure cap of said cylinder and adapted to be threaded inwardly until said locking recess on said guide rod is engagable by said locking clip for mechanically pulling said guide rod back outwardly to open said flapper valve and for threading inwardly to mechanically close said flapper valve.

* * * * *